US008328652B1

(12) United States Patent
Sardo

(10) Patent No.: US 8,328,652 B1
(45) Date of Patent: Dec. 11, 2012

(54) CUE TIP CHALK BLOCK SAVER

(76) Inventor: Philip Sardo, Sherman Oaks, CA (US)

( * ) Notice: Subject to any disclaimer, the term of this patent is extended or adjusted under 35 U.S.C. 154(b) by 0 days.

(21) Appl. No.: 13/298,538

(22) Filed: Nov. 17, 2011

(51) Int. Cl.
*A63D 15/16* (2006.01)

(52) U.S. Cl. ..... 473/36; 473/35

(58) Field of Classification Search ..... 473/35, 473/36, 37, 38, 39; D21/782; 30/494
See application file for complete search history.

(56) References Cited

U.S. PATENT DOCUMENTS

| | | | | |
|---|---|---|---|---|
| 363,898 | A * | 5/1887 | Labre | 473/36 |
| 451,938 | A * | 5/1891 | Klapperich | 473/38 |
| 497,886 | A | 5/1893 | Munro | |
| 1,194,212 | A * | 8/1916 | Moore | 473/39 |
| 1,332,431 | A | 8/1919 | Darras | |
| 1,674,808 | A * | 6/1928 | Suzuki | 473/36 |
| 1,957,549 | A | 7/1932 | Matteson | |
| 3,843,120 | A * | 10/1974 | Ricci | 473/2 |
| D273,315 | S | 4/1984 | Matteson | |
| 5,208,985 | A * | 5/1993 | Carter | 30/494 |
| 5,328,411 | A | 7/1994 | Thornton, II | |
| 5,382,196 | A * | 1/1995 | Lodrick | 473/38 |
| 5,545,093 | A * | 8/1996 | Contestabile et al. | 473/36 |
| 5,697,852 | A | 12/1997 | Adelson et al. | |
| 6,905,417 | B1 * | 6/2005 | Tona et al. | 473/36 |

FOREIGN PATENT DOCUMENTS

DE 202011000816 U1 * 7/2011

* cited by examiner

*Primary Examiner* — Mitra Aryanpour
(74) *Attorney, Agent, or Firm* — Goldstein Law Offices, P.C.

(57) ABSTRACT

A portable apparatus for boring a dimple within a block of cue tip chalk. The apparatus includes a platform having an opening fully protruding therethrough. The apparatus also includes a column having an upper end and a lower end. The lower end includes a blade. The column is disposed within the opening substantially perpendicular to the platform. Upon application of a force on the upper end, the column moves with respect to the platform in a direction substantially perpendicular to the platform. The blade is configured to bore the dimple. The column is coupled to a spring biased to maintain the column in a position the column was in prior to the application of the force. The apparatus further includes a means for controlling an extent of movement of the column in the direction.

11 Claims, 9 Drawing Sheets

CUE TIP CHALK BLOCK SAVER

TECHNICAL FIELD

The present disclosure relates generally to billiards. More particularly, the present disclosure relates to a cue tip chalk block saver.

BACKGROUND

Billiards is a game played by many people worldwide. Prior to or during the game, a player often applies a block of cue tip chalk to a tip of a billiard cue. During such process, many players hold an exposed portion of the block against the tip and then rotate either the cue or the block to transfer a desired chalk coating onto the tip. The rotation forms or expands a dimple, which keeps the tip centered on the exposed portion of the block and facilitates first few uses of the block if the block is new.

As the block is repeatedly applied onto the cue, the dimple grows deeper and its depth eventually renders the block practically useless for experienced players. However, such block is not really used up. Rather, the block generally contains a substantial amount of unused chalk, often as much as or more than has been previously used.

Although individual cue tip chalk blocks are not particularly expensive, with growth of billiards as a popular form of entertainment and accompanying rise of chains of billiard establishments, cumulative replacement of such blocks incurs a significant operating expense. At least operators of such establishments would benefit from a technology for effectively extending operational life of a cue tip chalk block as such extension would cumulatively provide a potentially large and welcome cost saving.

Accordingly, an effective way of extending operational life of a cue tip chalk block is desired.

BRIEF SUMMARY

It is an object of an example embodiment of the present disclosure to provide for an effective way of extending operational life of a cue tip chalk block. Accordingly, an example embodiment of the present disclosure is a portable apparatus for boring a dimple within a block of cue tip chalk. The apparatus includes a platform having an opening fully protruding therethrough. The apparatus also includes a column having an upper end and a lower end. The lower end includes a blade. The column is disposed within the opening substantially perpendicular to the platform. Upon application of a force on the upper end, the column moves with respect to the platform in a direction substantially perpendicular to the platform. The blade is configured to bore the dimple. The column is coupled to a spring biased to maintain the column in a position the column was in prior to the application of the force. The apparatus further includes a means for controlling an extent of movement of the column in the direction.

Another example embodiment of the present disclosure is a portable apparatus for boring a dimple within a block of cue tip chalk. The apparatus includes a platform having an opening fully protruding therethrough. Within the opening, the platform includes a platform screw thread. The apparatus also includes a column having a lower end. The lower end includes a blade. The column includes a column screw thread meshing with the platform screw thread. The column is disposed within the opening substantially perpendicular to the platform. Upon application of a rotational force, the column moves via the platform screw thread with respect to the platform in a direction substantially perpendicular to the platform. The blade is configured to bore the dimple.

Yet another example embodiment of the present disclosure is a method for boring a dimple within a block of cue tip chalk via a portable apparatus. The block includes an exposed portion and an unexposed portion directly opposing the exposed portion. The apparatus includes a platform having an opening fully protruding therethrough. The apparatus includes a column having a lower end. The lower end includes a blade. The column is disposed within the opening substantially perpendicular to the platform. Upon application of a force, the column moves with respect to the platform in a direction substantially perpendicular to the platform. The blade configured to bore the dimple. The apparatus includes a means for controlling an extent of movement of the column in the direction. The method includes exposing the unexposed portion, positioning the exposed unexposed portion under the blade and applying the force to the column.

DETAILED DESCRIPTION OF THE PREFERRED EMBODIMENTS

Figure 1:
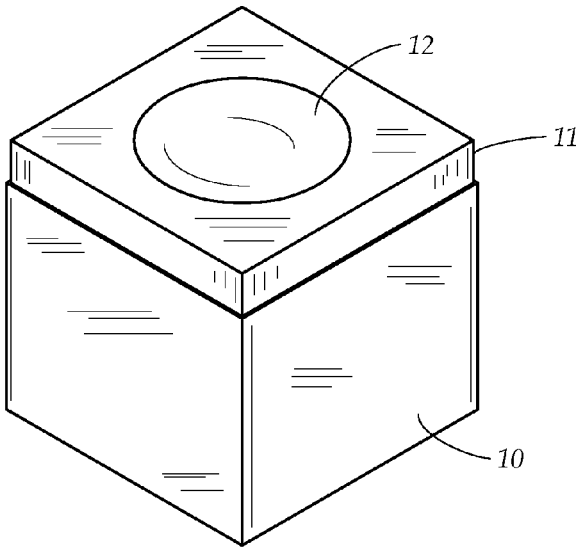
FIG. 1 is a perspective view of an example embodiment of a usable dimple of a cue tip chalk block in a cue tip chalk block case according to the present disclosure.

The present disclosure now will be described more fully hereinafter with reference to the accompanying drawings, which show various example embodiments. However, the present disclosure may be embodied in many different forms and should not be construed as limited to the embodiments set forth herein. Rather, these embodiments are provided so that the present disclosure is thorough, complete and fully conveys the scope of the disclosure to those skilled in the art.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

FIG. 1 is a perspective view of an example embodiment of a usable dimple of a cue tip chalk block in a cue tip chalk block case according to the present disclosure.

A cue tip chalk block case 10 stores a block 11 of cue tip chalk. A usable dimple 12 is present in block 11. Although case 10 is cuboid, case 10 can have other shapes, such as circular or rectangular.

Figure 2:
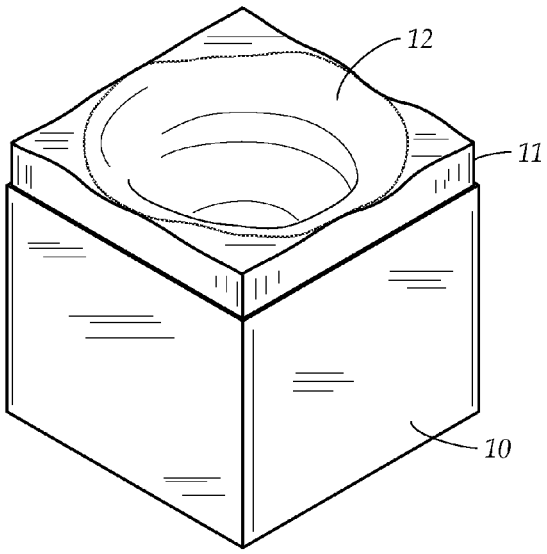
FIG. 2 is a perspective view of an example embodiment of an unusable dimple of the cue tip chalk block in the cue tip chalk block case according to the present disclosure.

FIG. 2 is a perspective view of an example embodiment of an unusable dimple of the cue tip chalk block in the cue tip chalk block case according to the present disclosure. Some elements of FIG. 2 are described above with respect to FIG. 1. Thus, same reference characters identify same or like components described above and any repetitive detailed description thereof will hereinafter be omitted or simplified in order to avoid complication.

As block 11 is repeatedly used, dimple 12 grows deeper and its depth eventually renders block 11 practically useless for experienced players. Hence, dimple 12 is unusable for an experienced player. However, block 11 is not really used up. Rather, block 11 contains a substantial amount of unused chalk, often as much as or more than has been previously used.

Figure 3:
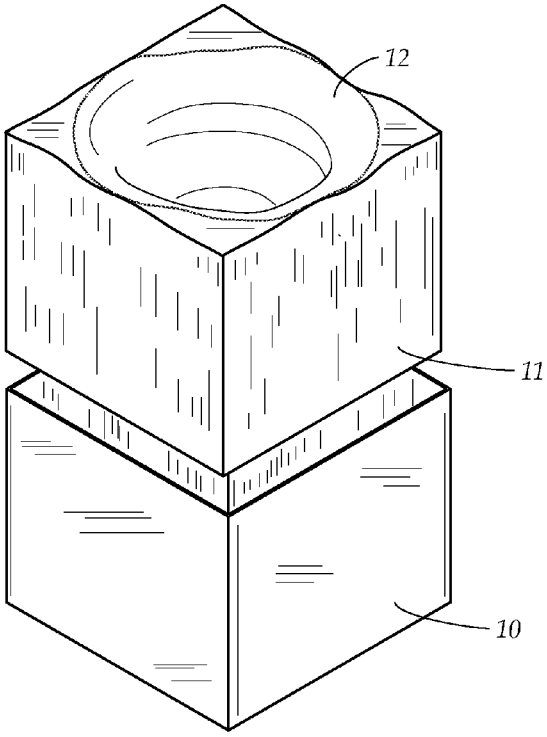
FIG. 3 is a perspective view of an example embodiment of the cue tip chalk block being removed from the cue tip chalk block case according to the present disclosure.

FIG. 3 is a perspective view of an example embodiment of the cue tip chalk block being removed from the cue tip chalk block case according to the present disclosure. Some elements of FIG. 3 are described above with respect to FIGS. 1-2. Thus, same reference characters identify same or like components described above and any repetitive detailed description thereof will hereinafter be omitted or simplified in order to avoid complication.

Block 11 is removed from case 10. An unexposed portion of block 11 is visible. Dimple 12 is in an exposed portion of block 11.

Figure 4:
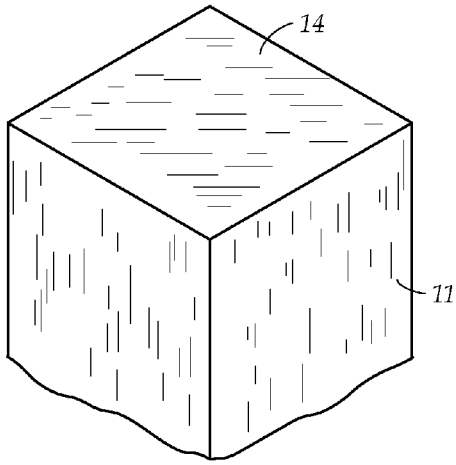
FIG. 4 is a perspective view of an example embodiment of the cue tip chalk block turned upside down according to the present disclosure.

FIG. 4 is a perspective view of an example embodiment of the cue tip chalk block turned upside down according to the present disclosure. Some elements of FIG. 4 are described above with respect to FIGS. 1-3. Thus, same reference characters identify same or like components described above and any repetitive detailed description thereof will hereinafter be omitted or simplified in order to avoid complication.

Block 11 is turned upside down, with dimple 12 facing downward. A side 14 of block 11 directly opposing dimple side of block 11 having dimple 12 is visible.

Figure 5:
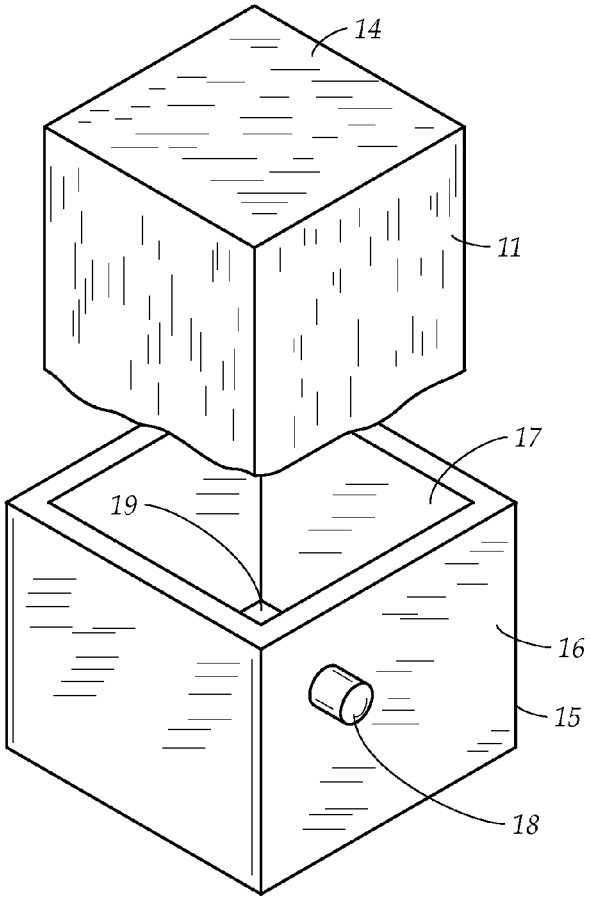
FIG. 5 is a perspective view of an example embodiment of the upside down cue tip chalk block about to be inserted into a cue tip chalk block holder according to the present disclosure.

FIG. 5 is a perspective view of an example embodiment of the upside down cue tip chalk block about to be inserted into a cue tip chalk block holder according to the present disclosure. Some elements of FIG. 5 are described above with respect to FIGS. 1-4. Thus, same reference characters identify same or like components described above and any repetitive detailed description thereof will hereinafter be omitted or simplified in order to avoid complication.

A cue tip chalk block holder 15 includes a plurality of holder walls 16 depending from a holder base 19. Holder walls 16 define a holder interior space 17. Although holder walls 16 are perpendicular to holder base 19, holder walls 16 can be angled otherwise. Holder walls 16 are sized to at least partially encapsulate block 11. A plurality of shafts 18 are coupled to outer surfaces of parallel walls of holder walls 16. Shafts 18 are directly opposing each other as if being one shaft extending through holder interior space 17 or shafts 18 are opposing each other as if being parallel to each other.

Block 11, which is turned upside down with dimple 12 directly facing holder interior space 17, is about to be inserted into holder interior space 17. Then, dimple 12 will directly face holder interior space 17 and side 14 will remain visible.

Figure 6:
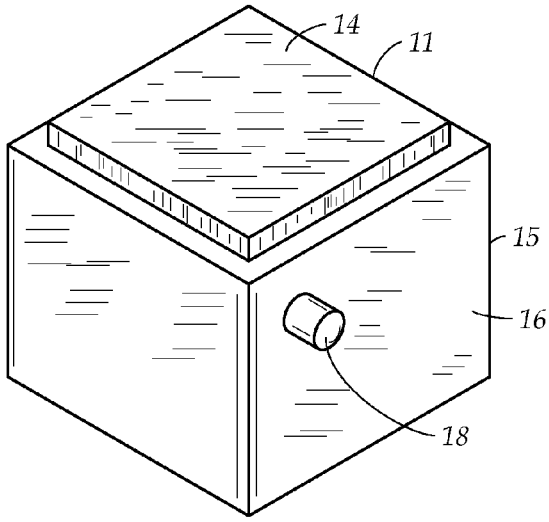
FIG. 6 is a perspective view of an example embodiment of the upside down cue tip chalk block inserted into the cue tip chalk block holder according to the present disclosure.

FIG. 6 is a perspective view of an example embodiment of the upside down cue tip chalk block inserted into the cue tip chalk block holder according to the present disclosure. Some elements of FIG. 6 are described above with respect to FIGS. 1-5. Thus, same reference characters identify same or like components described above and any repetitive detailed description thereof will hereinafter be omitted or simplified in order to avoid complication.

Block 11 is inserted into block holder 15 with side 14 being visible and dimple 12 directly facing holder interior space 17.

Figure 7:
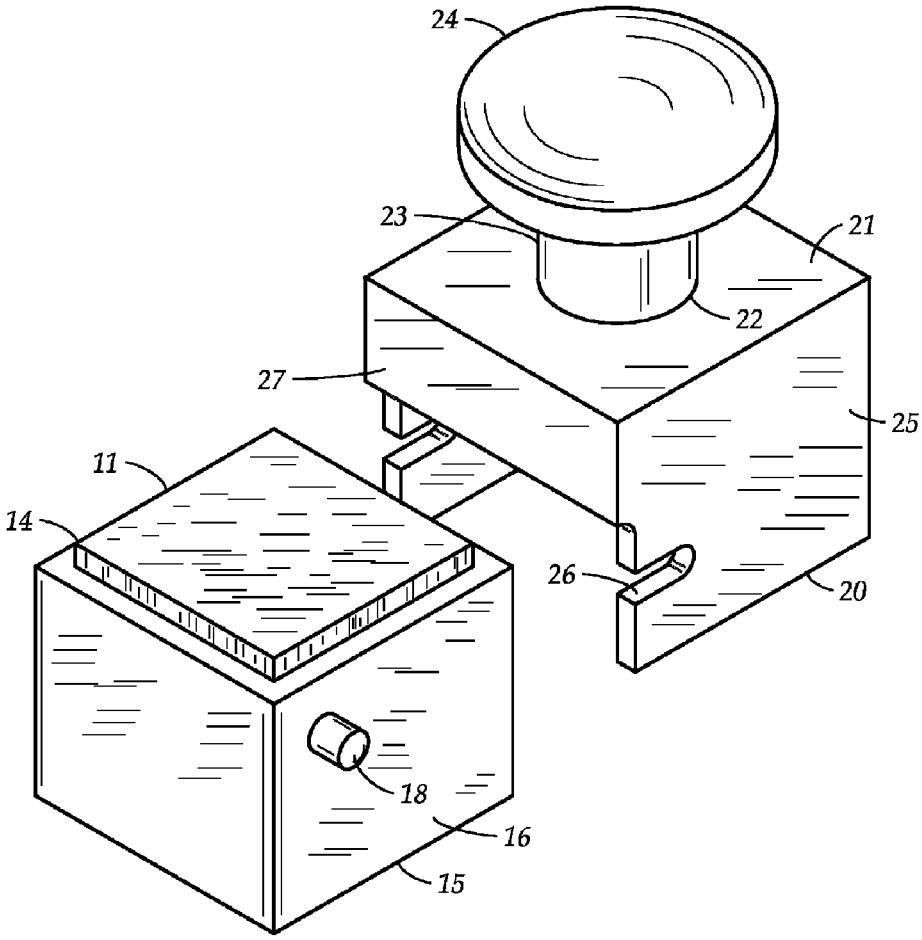
FIG. 7 is a perspective view of an example embodiment of the cue tip chalk block holder before insertion into a cue tip chalk block dimple former according to the present disclosure.

FIG. 7 is a perspective view of an example embodiment of the cue tip chalk block holder before insertion into a cue tip chalk block dimple former according to the present disclosure. Some elements of FIG. 7 are described above with respect to FIGS. 1-6. Thus, same reference characters identify same or like components described above and any repetitive detailed description thereof will hereinafter be omitted or simplified in order to avoid complication.

A cue tip chalk block dimple former 20 is a portable apparatus for boring a dimple in an unused block of cue tip chalk or another dimple, besides dimple 12, within block 11.

Cue tip chalk block dimple former 20 includes a platform 21 having an opening 22 fully protruding through platform 21. Opening 22 can be of any shape and be stationed on any portion of vertical surface of platform 21. Platform 21 can include metal, wood or plastic.

Cue tip chalk block dimple former 20 includes a column 23. A handle 24 is secured to column 23. Although handle 24 is circular, handle 24 can be shaped otherwise. Column 23 is disposed within opening 22 substantially perpendicular to platform 21. Upon application of a substantially vertical force, column 23 moves with respect to platform 21 in a direction of the force.

Cue tip chalk block dimple former 20 includes a plurality of platform walls 25 depending from platform 21. Platform walls 25 define a platform walls interior space therein. Platform walls 25 are angled substantially perpendicular to platform 21. Platform walls 25 are sized to at least partially encapsulate block 11, which is stationed within block holder 15. At least two of platform walls 25 are parallel and each includes a plurality of grooves 26 fully protruding through the at least two of platform walls 25. Shafts 18 travel within grooves 26 when block holder 15 is inserted into the platform walls interior space. Block holder 15 fits within the platform walls interior space when column 23 moves.

Cue tip chalk block dimple former 20 includes a wall 27 above grooves 26. Once block holder 15 is inserted into the platform walls interior space, wall 27 is co-planar with one wall of block holder 15.

In another example embodiment, block holder 15 is cuboid. Externally, holder base 19 and each holder wall 16 are about 1 and about 3/16 inches long. Internally, i.e. facing holder interior space 17, holder base 19 and each holder wall 16 are about 3/4 inches long.

In yet another example embodiment, cue tip chalk block dimple former 20 is also cuboid. Externally, each platform wall 25 and platform 21 are about 1 and about 5/16 inches long. Internally, i.e. facing the platform walls interior space, each platform wall and platform 21 are about 7/8 of an inch long.

Figure 8:
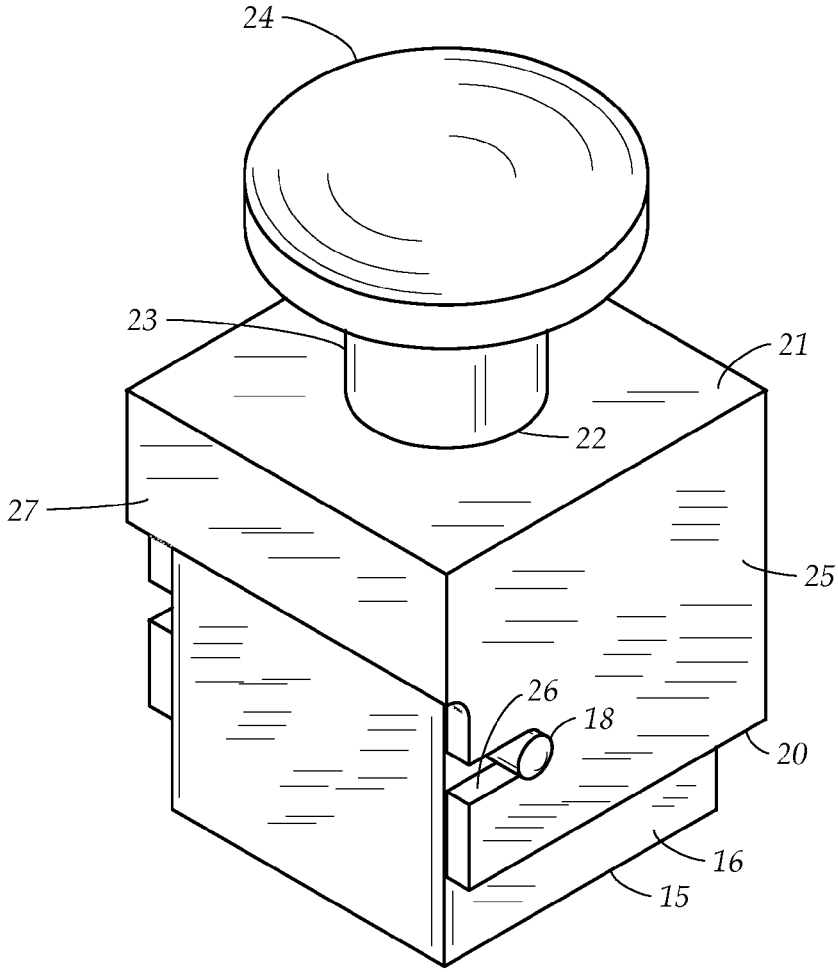
FIG. 8 is a perspective view of an example embodiment of the cue tip chalk block holder inserted into the cue tip chalk block dimple former according to the present disclosure.

FIG. 8 is a perspective view of an example embodiment of the cue tip chalk block holder inserted into the cue tip chalk block dimple former according to the present disclosure. Some elements of FIG. 8 are described above with respect to FIGS. 1-7. Thus, same reference characters identify same or like components described above and any repetitive detailed description thereof will hereinafter be omitted or simplified in order to avoid complication.

Block holder 15 is inserted into the platform walls interior space of cue tip chalk block dimple former 20. Shafts traveled within grooves 26 until each respective end of grooves 26. Block holder 15 fits within the platform walls interior space when column 23 moves. Wall 27 is co-planar with one wall of block holder 15.

Figure 9:
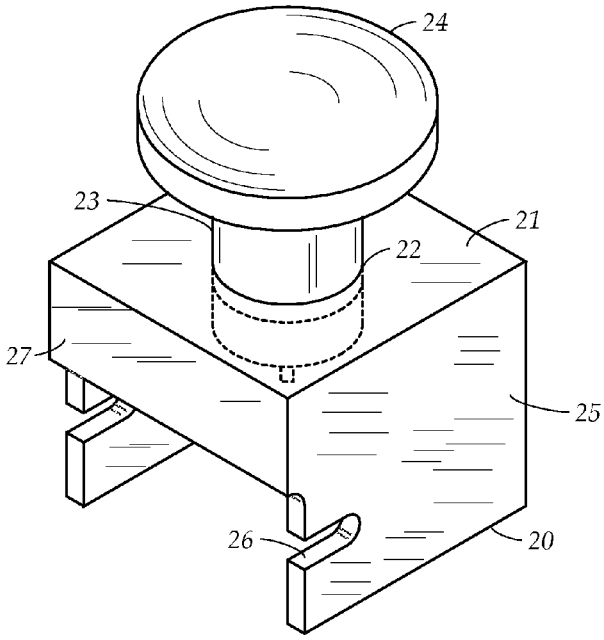
FIG. 9 is a perspective view of an example embodiment of a column extending through a platform of the cue tip chalk block dimple former according to the present disclosure.

FIG. 9 is a perspective view of an example embodiment of a column extending through a platform of the cue tip chalk block dimple former according to the present disclosure. Some elements of FIG. 9 are described above with respect to FIGS. 1-8. Thus, same reference characters identify same or like components described above and any repetitive detailed description thereof will hereinafter be omitted or simplified in order to avoid complication.

Column 23 is disposed fully through opening 22 and is substantially perpendicular to platform 21. Thus, when column 23 moves vertically downward, a portion of column 23 at least partially protrudes through opening 22.

Figure 10:
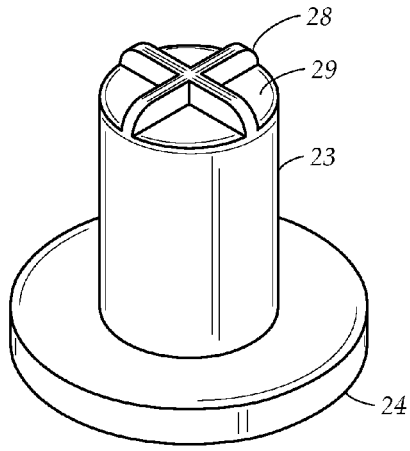
FIG. 10 is a perspective view of an example embodiment of a blade of the cue tip chalk block dimple former according to the present disclosure.

FIG. 10 is a perspective view of an example embodiment of a blade of the cue tip chalk block dimple former according to the present disclosure. Some elements of FIG. 10 are described above with respect to FIGS. 1-9. Thus, same reference characters identify same or like components described above and any repetitive detailed description thereof will hereinafter be omitted or simplified in order to avoid complication.

Column 23 is turned upside down. Column 23 can be hollow or full. Column 23 includes a lower base 29. Lower base 29 includes a blade 28. In an alternative example embodiment, column 23 includes blade 28 without lower base 29. In another alternative example embodiment, column 23 includes blade 28 without lower base 29 and blade 28 is configured to allow chalk particles to pass past blade 28 into a body of column 23 when column 23 vertically moves to create a dimple. Although blade 28 is cross-shaped, blade 28 can be shaped otherwise, such as star, triangle, circular, rectangle, trapezoid or linear or any combination of the foregoing shapes. Blade 28 projects away from lower base 29. Blade 28 is configured to bore similar to dimple 12.

Figure 11:
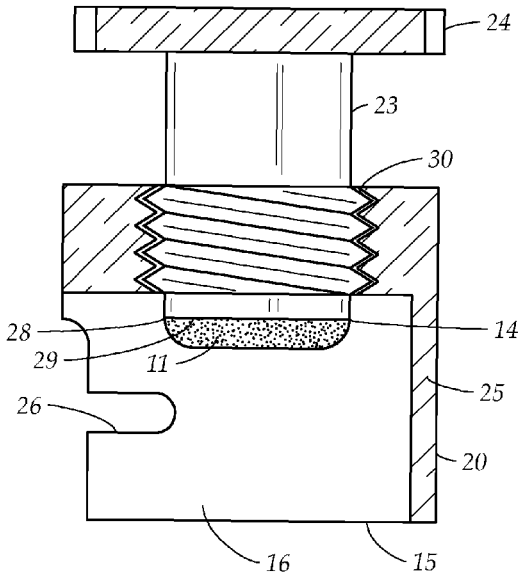
FIG. 11 is a cross-sectional view of an example embodiment of a column with screw threads according to the present disclosure.

FIG. 11 is a cross-sectional view of an example embodiment of a column with screw threads according to the present disclosure. Some elements of FIG. 11 are described above with respect to FIGS. 1-10. Thus, same reference characters identify same or like components described above and any repetitive detailed description thereof will hereinafter be omitted or simplified in order to avoid complication.

Within opening 22, platform 21 includes a screw thread 30 of internal screw thread kind. Column 23 includes a corresponding screw thread of external screw thread kind. Upon application of a rotational force, column 23 moves via screw thread 30 with respect to platform 21 in a vertical direction substantially perpendicular to platform 21. Upon contacting side 14, blade 28 bores a dimple within block 11. During the vertical movement of column 23, particles bored from block 11 are pushed sideways and eventually fall off a top edge of at least one of walls of holder walls 16.

Figure 12:
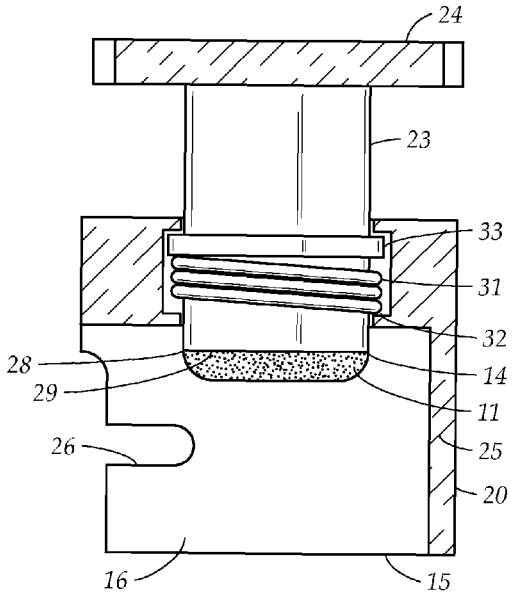
FIG. 12 is a cross-sectional view of an example embodiment of a column coupled to a spring according to the present disclosure.

FIG. 12 is a cross-sectional view of an example embodiment of a column coupled to a spring according to the present disclosure. Some elements of FIG. 12 are described above with respect to FIGS. 1-10. Thus, same reference characters identify same or like components described above and any repetitive detailed description thereof will hereinafter be omitted or simplified in order to avoid complication.

Column 23 is coupled to a coil spring 31 biased to maintain column 23 in a position column 23 was in prior to the application of the force. Within opening 22, platform 21 includes a plurality of projections 32 projecting toward column 23. Column 23 includes a band 33 set on column 23 between projections 32. Upon application of a substantially vertical force, column 23 moves with respect to platform 21 in a direction of the force. Via an upper projection of projections 32, band 33 restricts upward vertical movement of column 23. Via a lower projection of projections 32, downward vertical movement of spring 31 is restricted. Thus, blade 28 is effectively prevented from tunneling through block 11 to connect to dimple 12.

Figure 13:
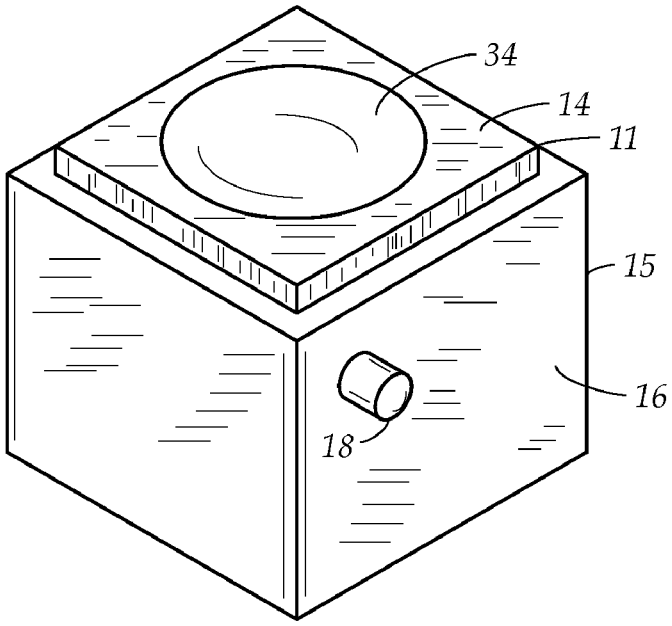
FIG. 13 is a perspective view of an example embodiment of another usable dimple on an opposing side of the cue tip chalk block in the cue tip chalk block holder according to the present disclosure.

FIG. 13 is a perspective view of an example embodiment of another usable dimple on an opposing side of the cue tip chalk block in the cue tip chalk block holder according to the present disclosure.

Some elements of FIG. 13 are described above with respect to FIGS. 1-12. Thus, same reference characters identify same or like components described above and any repetitive detailed description thereof will hereinafter be omitted or simplified in order to avoid complication.

Cue tip chalk block holder 15 is removed from cue tip chalk block dimple former 20. A new dimple 34 is bored within block 11 is clearly visible. Hence, operation life of cue tip chalk block 11 is effectively extended as block 11 can still be used at least by experienced billiards players.

Figure 14:
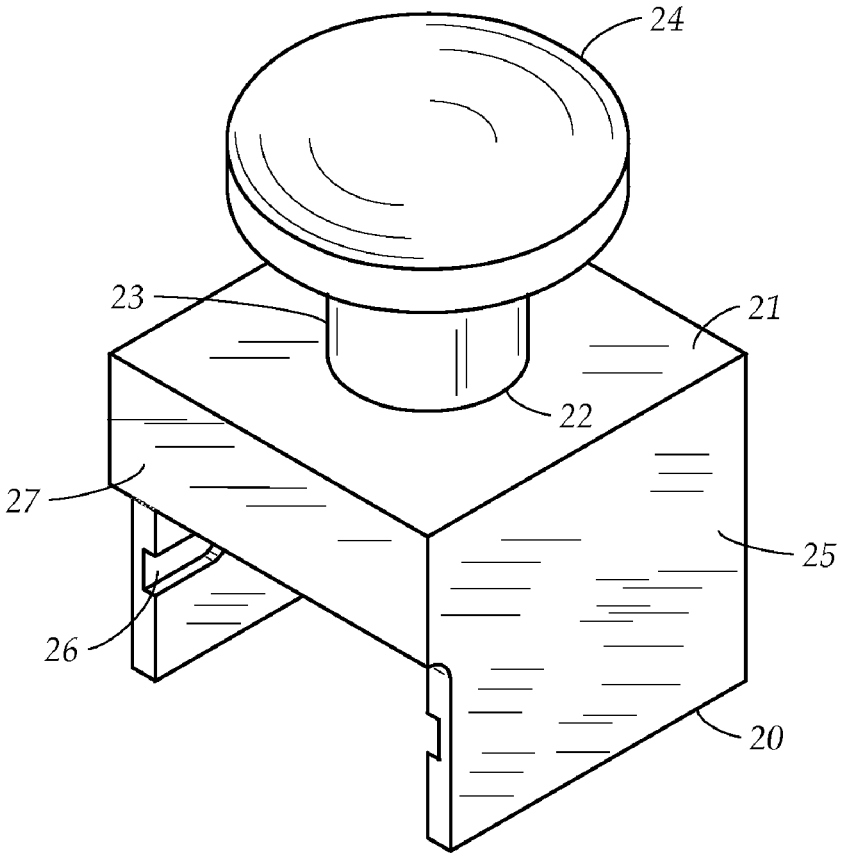
FIG. 14 is a perspective view of an example embodiment of the cue tip chalk block dimple former according to the present disclosure.

FIG. 14 is a perspective view of an example embodiment of the cue tip chalk block dimple former according to the present disclosure. Some elements of FIG. 14 are described above with respect to FIGS. 1-13. Thus, same reference characters identify same or like components described above and any repetitive detailed description thereof will hereinafter be omitted or simplified in order to avoid complication.

At least two of platform walls 25 are parallel and each includes a plurality of grooves 26 partially protruding through the at least two of platform walls 25. Shafts 18 travel within grooves 26 when block holder 15 is inserted into the platform walls interior space. Block holder 15 fits within the platform walls interior space when column 23 moves.

The invention claimed is:

1. A portable apparatus for boring a dimple within a block of cue tip chalk, the apparatus comprising:

a platform having an opening fully protruding therethrough;

a column having an upper end and a lower end, the lower end includes a blade, the column disposed within the opening substantially perpendicular to the platform, the platform including a plurality of platform walls, wherein the platform walls define an interior space therein;

a cue tip chalk block holder, the chalk block holder is encapsulated within the interior space formed by the platform walls; and upon application of a force on the upper end, the column moves with respect to the platform in a direction substantially perpendicular to the platform, the blade configured to bore the dimple within the cue tip chalk block, and wherein the coupled is coupled to a spring, the spring is biased to maintain the column in a position the column was in, prior to the application of the force; and a means for controlling an extent of movement of the column in the direction substantially perpendicular to the platform.

2. The apparatus of claim 1, wherein the platform walls are angled substantially perpendicular to the platform.

3. The apparatus of claim 2, wherein the blade is cross-shaped.

4. The apparatus of claim 2, further comprising the cue tip chalk block holder having a holder base and a plurality of holder walls depending from the holder base, wherein the holder walls angled substantially perpendicular to the holder base, the holder walls sized to at least partially encapsulate the cue tip chalk block, at least two of the plurality of holder walls are parallel and each includes a shaft on an outer surface, at least two of the plurality of platform walls are parallel and each includes a groove, the shafts travel within the grooves when the holder is inserted into the interior space.

5. The apparatus of claim 4, further comprising a handle, wherein the handle is secured to the column.

6. A portable apparatus for boring a dimple within a block of cue tip chalk, the apparatus comprising:

a platform having an opening fully protruding therethrough, within the opening the platform includes a platform screw thread;

a column having a lower end, the lower end includes a blade, the column includes a column screw thread meshing with the platform screw thread, the column disposed within the opening substantially perpendicular to the platform, the platform including a plurality of platform walls, wherein the platform walls define an interior space therein;

a cue tip chalk block holder, the chalk block holder is encapsulated within the interior space formed by the platform walls; and upon application of a rotational force, the column moves via the platform screw thread with respect to the platform in a direction substantially perpendicular to the platform, the blade configured to bore the dimple within the cue tip chalk block.

7. The apparatus of claim 6, wherein the platform walls are angled substantially perpendicular to the platform.

8. The apparatus of claim 7, wherein the blade is cross-shaped.

9. The apparatus of claim 7, the cue tip chalk block holder having a holder base and a plurality of holder walls depending from the holder base, wherein the holder walls angled substantially perpendicular to the holder base, the holder walls sized to at least partially encapsulate the cue tip chalk block, at least two of the plurality of holder walls are parallel and each includes a shaft on an outer surface, and at least two of the plurality of platform walls are parallel and each includes a groove, the shafts travel within the grooves when the holder is inserted into the interior space.

10. The apparatus of claim 9, further comprising a handle, wherein the handle is secured to the column.

11. A method for boring a dimple within a block of cue tip chalk via a portable apparatus, the method comprising the steps of:

providing a block of cue tip chalk, the block cue tip chalk includes an exposed portion and an unexposed portion directly opposing the exposed portion, providing an apparatus, the apparatus includes a platform having an opening fully protruding therethrough, the apparatus includes a column having a lower end, the lower end includes a blade, the column disposed within the platform opening substantially perpendicular to the platform, the platform including a plurality of platform walls, wherein the platform walls define an interior space therein;

positioning a cue tip chalk block holder within the interior space formed by the platform walls;

providing a means for controlling an extent of movement of the column in the direction of the platform, exposing the unexposed portion of the block of cue tip chalk;

positioning the unexposed portion under the blade; and applying force to the column such that the column moves with respect to the platform in a direction substantially perpendicular to the platform, the blade configured to bore the dimple within the unexposed portion of the block of cue tip chalk.

* * * * *